US005085818A

United States Patent [19]

Hamlyn et al.

[11] Patent Number: 5,085,818

[45] Date of Patent: Feb. 4, 1992

[54] PROCESS FOR DIMENSIONALLY STABLE POLYESTER YARN

[75] Inventors: Maxwell C. Hamlyn, Cary; Thomas H. Luck, Sanford, both of N.C.; Charles J. Nelson, Chesterfield, Va.

[73] Assignee: Allied-Signal Inc., Morris Township, Morris County, N.J.

[21] Appl. No.: 545,321

[22] Filed: Jun. 26, 1990

Related U.S. Application Data

[63] Continuation-in-part of Ser. No. 292,864, Jan. 3, 1989, abandoned.

[51] Int. Cl.[5] ..... D01F 6/62

[52] U.S. Cl. ..... 264/210.6; 264/210.8; 264/211.14; 264/211.15; 264/211.17

[58] Field of Search ..... 264/210.8, 211.14, 211.15, 264/290.5, 210.6, 211.17

[56] References Cited

U.S. PATENT DOCUMENTS

| | | | |
|---|---|---|---|
| 4,003,974 | 1/1977 | Chantry et al. | 264/210.8 |
| 4,049,763 | 9/1977 | Mineo et al. | 264/210.8 |
| 4,195,052 | 3/1980 | Davis et al. | 264/210.8 |
| 4,251,481 | 2/1981 | Hamlyn | 264/210.8 |
| 4,491,657 | 1/1985 | Saito et al. | 528/308.1 |
| 4,690,866 | 9/1987 | Kumakawa | 428/364 |
| 4,827,999 | 5/1989 | Yabuki et al. | 152/451 |

FOREIGN PATENT DOCUMENTS

| | | | |
|---|---|---|---|
| 63-190014 | 8/1988 | Japan | 264/210.8 |

*Primary Examiner*—Hubert C. Lorin
*Attorney, Agent, or Firm*—William H. Thrower

[57] ABSTRACT

A process for production of a dimensionally stable drawn polyethylene terephthalate multifilament yarn having filaments of at least 2.5 denier per filament comprising the steps of:

a) extruding a polyethylene terephthalate polymer melt through a spinnerette having a plurality of extrusion orifices to form filaments;

b) advancing the extruded multifilament yarn first through a delay zone then through a quenching zone to solidify the filaments in a controlled manner;

c) withdrawing the solidified multifilament yarn from the quenching zone at a desired spinning speed V; whereby steps a) through c) are performed under conditions to form a partially-oriented multifilament yarn having a undrawn birefringence ($\Delta n_u$) of at least 0.020 and wherein $\Delta n_u = R_f V^{2.0} IV^{2.4}$ where IV is the intrinsic viscosity of the undrawn yarn and is at least 0.80 and $R_f$ is at least $9.0 \times 10^{-3}$; then d) hot drawing the partially-oriented multifilament yarn. The process permits production of high undrawn birefringence yanrs at lower speeds and lower IV's than previously demonstrated in the prior art.

24 Claims, 1 Drawing Sheet

PROCESS FOR DIMENSIONALLY STABLE POLYESTER YARN

This is a continuation-in-part of copending U.S. Ser. No. 292,864, filed Jan. 3, 1989, now abandoned.

FIELD OF THE INVENTION

This invention relates to a process for production of polyester multi-filament drawn yarn of 2.5 denier per filament or greater, whereby high birefringence ($\Delta n$) yarns are prepared at lower spinning speeds and lower intrinsic viscosity than prior art processes.

DESCRIPTION OF THE PRIOR ART

Polyethylene terephthalate filaments of high strength are well known in the art and are commonly utilized in industrial applications including tire cord for rubber reinforcement, conveyor belts, seat belts, V-belts and hosing.

Dimensionally stable polyester (DSP) industrial yarns are desired to minimize sidewall indentations (SWI) in the bodies of radial tires and to achieve good tire handling characteristics. An additional objective is to make advanced DSP's having the strength and modulus equivalent to rayon at elevated tire service temperatures, while using up to 30 percent less material. While the current polyester tire cords have sufficient strength, their elevated temperature modulus is too low. U.S. Pat. No. 4,101,525 to Davis et al. provides a high strength multifilament polyester yarn with low shrinkage and work-loss characteristics. While yarns exhibiting the features taught by Davis are classified as DSP's, they do not meet the modulus requirements for rayon replacement. Additionally, low denier per filament (dpf of 2 or less) and rapid cooling of the filament immediately after emerging from the spinneret can result in excessive filament breakage and thus yield yarn with poor mechanical quality. U.S. Pat. No. 4,491,657 to Saito et al. discloses high modulus, low shrinkage polyester yarn, but requires a low terminal modulus to achieve good yarn to treated cord conversion efficiency for such dimensionally stable yarns. The low terminal modulus is translated into the treated cord and results in a lower tenacity than the high terminal modulus cords made by present invention. The process of Saito et al. requires high spinning speeds, which makes it difficult to incorporate the Saito process into a continuous spin-draw process, whereas the present invention permits the use of lower spinning speeds whereby more readily available and/or less costly equipment can be used.

U.S. Pat. No. 4,690,866 to Kumakowa et al. describes a means of making yarns which yield highly dimensionally stable treated cords using ultra high viscosity polymer. On a comparative experimental basis, i.e. utilizing our solvent system, the Kumakowa intrinsic viscosity (IV) values would be 5% higher than indicated in their patent, i.e. they require a minimum of 0.95 IV polymer by our measurements. Also, these cords have low terminal modulus and hence do not achieve the full tenacity benefit of a given polymer viscosity.

It is known, shown by the prior art cited above, that undrawn birefringence can be increased by increasing the spinning speed or yarn IV.

An important need exists for a process to produce high undrawn birefringence ($\Delta n_u$) yarns at lower spinning speeds and lower intrinsic viscosity (IV), than previously. Processing at lower speeds is important because of the speed limitations of commercial equipment, particularly winders. The ability to use lower IV means that costly processing steps such as solid state polymerization or costly/environmentally hazardous additives can be eliminated.

SUMMARY OF THE INVENTION

A process for production of a dimensionally stable drawn polyethylene terephthalate multifilament yarn having filaments of at least 2.5 denier per filament comprising the steps of:

a) extruding a polyethylene terephthalate polymer melt through a spinneret having a plurality of extrusion orifices to form filaments;

b) advancing the extruded multifilament yarn first through a delay zone then through a quenching zone to solidify the filaments in a controlled manner;

c) withdrawing the solidified multifilament yarn from the quenching zone at a desired spinning speed V; whereby steps a) through c) are performed under conditions to form a partially-oriented multifilament yarn having an undrawn birefringence ($\Delta n_u$) of at least 0.020 and wherein $\Delta n_u = R_f V^{2.0} IV^{2.4}$ where IV is the intrinsic viscosity of the undrawn yarn and is at least 0.80 and $R_f$ is at least $9.0 \times 10^{-3}$; then d) hot drawing the partially-oriented multifilament yarn. The process permits production of high undrawn birefringence yarns at lower speeds and lower IV's than previously demonstrated in the prior art.

DESCRIPTION OF THE PREFERRED EMBODIMENT

Figure 1:
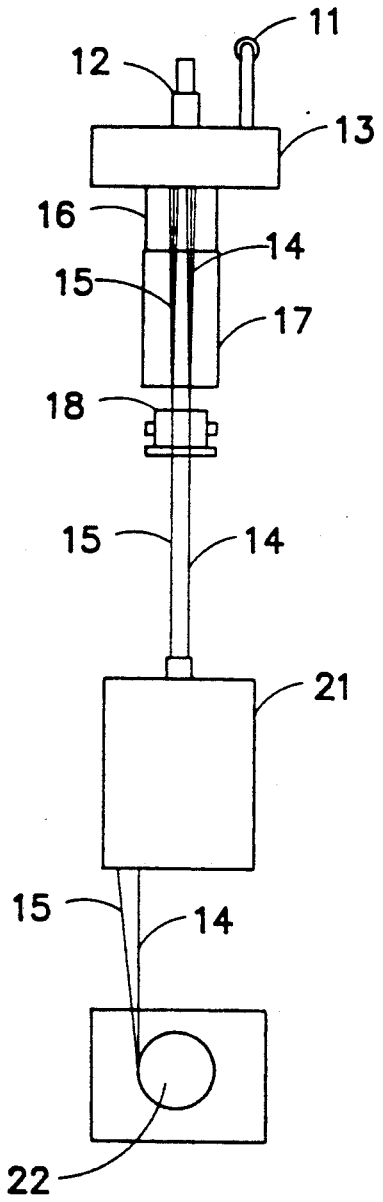

The dimensionally stable polyester multifilament yarns made by the process of the present invention provide dimensionally stable treated cords when incorporated as fibrous reinforcement into rubber composites such as tires.

Dimensional stability is defined as high modulus at a given shrinkage and directly relates to tire sidewall indentations (SWI) and tire handling. While the modulus of the cord in the tire is the primary variable governing both SWI and handling, shrinkage is important in two ways. First, excessive cord shrinkage during tire curing can significantly reduce the modulus from that of the starting treated cord. Second, cord shrinkage is a potential source of tire non-uniformity. Thus, comparison of modulus and tenacity at a given shrinkage is a meaningful comparison for tire cords. Since tire cords experience deformations of a few percent during service, a good practical measure of modulus is LASE-5 (load at 5 percent elongation). Alternatively, $E_{4.5}$ (elongation at 4.5 g/d load) can be used as a practical measure of compliance.

For both tire SWI and handling, modulus at elevated temperature (up to 110° C.) is the important parameter governing performance. Due to the highly crystalline nature of treated cords based on conventional or dimensionally stable tire yarns, the modulus retention (in percent) at elevated tire temperatures is essentially similar for all current commercial treated cords and for those of this invention when loss modulus peaks occur at 110° C. or greater. Thus, room temperature measurement of LASE-5 is sufficient to establish meaningful differences in polyester cord dimensional stability.

The polyester yarn contains at least 90 mol percent polyethylene terephthalate (PET). In a preferred embodiment, the polyester is substantially all polyethylene terephthalate. Alternatively, the polyester may incorporate as copolymer units minor amounts of units derived from one or more ester-forming ingredients other than ethylene glycol and terephthalic acid or its derivatives. Illustrative examples of other ester-forming ingredients which may be copolymerized with the polyethylene terephthalate units include glycols such as diethylene glycol, trimethylene glycol, tetramethylene glycol, hexamethylene glycol, etc., and dicarboxylic acids such as isophthalic acid, hexahydroterephthalic acid, bibenzoic acid, adipic acid, sebacic acid, azelaic acid, etc.

The polymer may be polymerized in a separate operation or polymerized in a directly coupled continuous polymerization and direct melt spinning process.

An important aspect of this invention permits obtaining high undrawn birefringence yarn without the need to utilize molecular weight enhancing additives such as multifunctional coupling agents exemplified by 2,2'-bis(2-oxazoline). Catalysts for the polymerization reaction are not considered to be included in the definition of molecular weight enhancing additive.

The multifilament yarn of the present invention commonly possesses a denier per filament of about 2.5 to 20 (e.g. about 3 to 10), and commonly consists of about 6 to 600 continuous filaments (e.g. about 20 to 400 continuous filaments). The denier per filament and the number of continuous filaments present in the yarn may be varied widely within the ranges of this invention as will be apparent to those skilled in the art.

The multifilament yarn made by the process is particularly suited for use in industrial applications including rubber composites, ropes, cordage and tarps. The fibers are particularly suited for use in environments where elevated temperatures (e.g. 80° C. to 100° C.) are encountered.

The yarn characterization parameters referred to herein may conveniently be determined by testing the multifilament yarn which consists of substantially parallel filaments.

Undrawn birefringence ($\Delta n_u$) was determined using a polarizing light microscope equipped with a Berek compensator.

Intrinsic viscosity (IV) of the polymer and yarn is a convenient measure of the degree of polymerization and molecular weight. IV is determined by measurement of relative solution viscosity ($\eta_r$) of PET sample in a mixture of phenol and tetrachloroethane (60/40 by weight) solvents. The relative solution viscosity ($\eta_r$) is the ratio of the flow time of a PET/solvent solution to the flow time of pure solvent through a standard capillary. Billmeyer approximation (J. Polym. Sci. 4, 83-86 (1949)) is used to calculate IV according to $$IV = .25\frac{(\eta_r - 1)}{C} + .75\frac{\ln\eta_r}{C}$$

where C is concentration in gm/100 ml. In this study, the concentration was 1.3 gms/100 ml. It will be understood that IV is expressed in units of deciliters per gram (dl/g), even when such units are not indicated. Comparison to IV measurements in other solvents is given in an article by C. J. Nelson and N. L. Hergenrother, J. Poly. Sci., 12 2905 (1974). The invention makes possible obtaining high modulus drawn yarn without the need to utilize exceptionally high IV polymer. Satisfactory drawn yarns with high $\Delta n_u$ with IV of at least 80, for example 0.85 to 0.95 can be obtained by this invention.

The tensile properties referred to herein were determined on yarns conditioned for two hours through the utilization of an Instron tensile tester (Model TM) using a 10-inch gauge length and a strain rate of 120 percent per minute in accordance with ASTM D885. All tensile measurements were made at room temperature.

Elongation at the specified load of 4.5 g/d ($E_{4.5}$) is inversely related to modulus. It is particularly useful in that the sum $E_{4.5}$+FS is a good indicator of dimensional stability for yarns processed under different relaxation levels. Lower sums ($E_{4.5}$+FS) indicate better dimensional stability. Drawn yarn of the present invention is produced with $\Delta n_u$ greater yarn than 0.020 and posses a dimensional stability defined by E4.5+-FS<16%. Free shrinkage (FS) values were determined in accordance with ASTM D885 with the exception that the testing load was 0.009 g/d. Such improved dimensional stability is of particular importance if the product serves as fibrous reinforcement in a radial tire.

Figure 2:
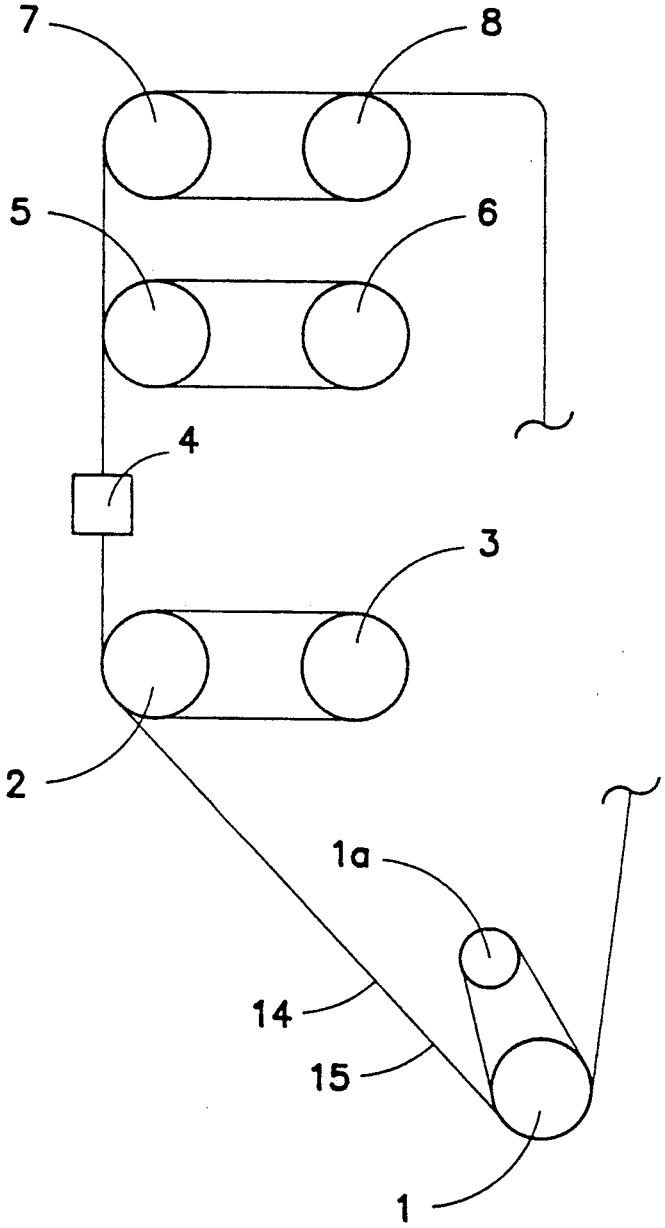

Identified hereafter is a description of the continuous spin-draw process which has been found to be capable of forming the desired improved yarns. FIGS. 1 and 2 illustrate apparatus which may be utilized to practice the process of this invention, though it will be recognized by those of skilled in the art that the apparatus illustrated may be modified in known ways.

Referring to FIGS. 1 and 2, like numbers indicate like apparatus. Molten polymer is fed by extruder 11 to spin pump 12 which feeds spin block 13 containing a spinneret and a spinning filter disposed between the spin pump and spinneret. The spinneret is designed for the extrusion of one or more ends of filaments, each end containing a plurality of filaments. FIG. 1 illustrates the simultaneous extrusion of two ends 14 and 15 of multifilament, continuous filament yarn from one spinneret. Ends 14 and 15 are extruded from the spinneret at a spinning temperature in the range of 282 to 320° C. and at a desired polymer volumetric flowrate (Q, $cm^3$/min/-capillary), and are passed downwardly from the spinneret into a delay zone, chamber 16, which preferably is a quiescent delay zone or a heated sleeve of a desired delay length preferably 1 to 40 inches, maintained at a desired heated sleeve temperature preferably 100° to 450° C. Yarn leaving chamber 16 is passed directly into the top of the quenching zone, apparatus 17, preferably a radial inflow quench. The quench chamber is an elongated chimney of conventional length for example 1 to 40 inches. Ends 14 and 15 of yarn are lubricated by finish applicator 18. A spinning finish composition is used to lubricate the filaments. For the examples in this application, finish applicator 18 was a lube roll which is rotated with the direction of the yarn movement. Other means of applying finish could also be used.

To achieve desired properties in the final drawn yarn, it is necessary to hot draw the partially-oriented multifilament yarn withdrawn from the quenching zone, for example to at least 85 percent of the maximum draw ratio. This can be accomplished either in an off-line drawing process or preferably in a continuous spin-draw process. The drawing may be multiple steps and include high temperature annealing with or without relaxation. In this illustration, ends 14 and 15 are then transported to spin draw panel 21. A typical configuration is shown in FIG. 2. In FIG. 2, ends 14 and 15, are all processed on the same single set of forwarding (first roll 1), drawing (rolls 2-3 and rolls 5-6) and relaxing rolls (rolls 7-8). From draw roll 2, the ends are passed through a steam impinging draw point localizing steam jet 4. From relaxing rolls 7 and 8, the yarn ends are forwarded to winder 22. For the discussion following V is taken as the linear speed of roll 1.

With respect to conditions for operating the apparatus to achieve the process of this invention, it is generally known that undrawn birefringence ($\Delta n_u$) can be increased by increasing the spinning speed (V given in km/min) or the IV of the yarn (dl/g). By experimental work accomplished during the course of this invention, this can now be quantified by the following experimentally determined relationship:

$$\Delta n_u = R_f V^{2.0} IV^{2.4}$$

V is the spinning speed given in kilometers/minute. IV is the intrinsic viscosity of the undrawn yarn given in dl/g. $R_f$ is a value characteristic of the additional processing variables other than V and IV. The ratio $\Delta n_u/IV^{2.4}$ is introduced to indicate the ability to achieve high $\Delta n_u$ for a given IV.

For conventional and prior art processes, $R_f$ is typically $\leqq 8\times10^{-3}$, whereas for the process of this invention $R_f$ is $\geqq 9.0\times10^{-3}$. Of course, the higher the $R_f$ value, the higher the undrawn birefringence for a given IV and V. Apparently, the combination of high molecular weight (IV>0.80) and inherent stiffness of the PET molecule results in a sufficiently slow relaxation rate in the molten state to achieve high $R_f$ values. High $R_f$ values, for example $R_4 \geqq 15\times10^{-3}$, are readily attainable by this invention and are of prime commercial interest. For more dimensionally stable products, it is preferred that $\Delta n_u/IV^{2.4}$ be at least 0.098.

$R_f$ can be broken down into two more basic terms:

$$R_f = R_r R_e$$

$R_r$ is related to the retention in orientation after thermally induced polymer relaxation. This parameter increases with increasing severity of the quenching and decreases with increasing extruded polymer temperature and heated sleeve length and temperature. One skilled in the art can adjust these parameters to maximize $\Delta n_u$ and still maintain good spinnability.

The core of the invention is in the $R_e$ term which is related to the effective polymer extension from flow orientation in the spinneret and draw-down in the spin column. The net result is substantial orientation even at moderate spinning speeds. The experimentally determined relationship is $$R_e = \frac{D^{0.5}}{Q^{0.7}}$$

where D is the spinneret capillary diameter (inches) and Q is the polymer flow rate through the capillary expressed in $cm^3$/min/capillary. Q is calculated using a polymer density of 1.2 gm/$cm^3$. This invention also teaches the proper combination of D and Q to achieve $R_e$ of at least $10.5\times10^{-2}$. More preferred, $R_e$e is at least $13\times10^{-2}$.

For D, a preferred diameter is at least 0.027 inches and less than 0.055 inches. This range represents an important processing range for optimizing fiber uniformity together with effective spinneret hole design options.

If one looks only at the IV range 0.80-0.95, a simplified expression may be obtained which shows the advantage of this invention over prior art, with $\Delta n_u$ of at least $7.0\times10^{-3}V^2$. It may be preferred to achieve even higher birefringence for a given V, with $\Delta n^u$ of at least $11.5\times10^{-3}V^2$. Thus, for this viscosity range, the invention can also be defined solely in terms of V.

The particular examples which follow show how proper selection of process variables results in $R_f \geqq 9.0\times10^{-3}$ and the desired improved yarns which exhibit improved dimensional stability. The comparative examples are taken from the patents previously cited and are summarized in Table I. This table contains all examples in which (a) the drawn yarn had a dpf of at least 2.5, (b) $\Delta n_u$ was at least 0.020, and (c) the yarn IV was between 0.85 and 0.96. The latter IV range was chosen since it is close to the 0.88-0.92 range in our examples.

EXAMPLE 1

PET polymer was pumped at 296° C. to a spinneret containing multiple orifices, each orifice of 0.030 inch diameter (D=0.030 inch). The extension rate per hole (Q) was 0.88 $cm^3$/min. The filaments were passed through a 1-inch heated sleeve and then quenched in a radial quench stack. The spun yarn was subsequently drawn on a panel similar to FIG. 2, with roll 1 maintained at 90° C., the yarn drawn 1.5/1 to unheated rolls 2, 3 with a normal ambient temperature of 40°-50° C., then drawn 1.6/1 from rolls 2, 3 to rolls 5, 6 maintained at 200° C., the yarn was then relaxed to rolls 7, 8 at 1 to 1.5 percent. Rolls 7 and 8 had an operating temperature of 150° C. The drawn yarn was taken up at 2.98 km/min. Polymer thruput for the two ends was 85 lbs./hour. The drawn yarn was 1004 denier, 3.3 dpf, 17.5 lbs. breaking strength, 7.9 g/d tenacity, 10.6 percent ultimate elongation, 3.9 g/d LASE-5, 5.5% $E_{4.5}$ and 9.2 percent FS. The sum $E_{4.5}$+FS is 14 percent. The undrawn yarn birefringence ($\Delta n_u$) was 0.026 and IV was 0.92 dl/g. $R_f$ was $24\times10^{-3}$. The yarn produced in this example, while produced at a moderate spinning take-up speed usually associated with standard yarn products, is then shown to have that enhanced dimensional stability associated with substantially higher spinning speeds in the prior art. $R_f$ and $R_e$ were $24\times10^{-3}$ and $19\times10^{-2}$, respectively.

EXAMPLE 2

An ultradimensionally stabilized PET was produced in the following manner. PET polymer was pumped into a spinneret containing multiple orifices, each orifice of 0.027 inch diameter (D=0.027 inch). Q was 1.3 $cm^3$/min/cap. The filaments were then passed through a heated sleeve (HST=220°-300° C., residence time 0.02-0.03 sec) and quenched in a radial quench stack. The spun yarn was first drawn 1.4/1 between rolls at 90° C. and unheated rolls, then drawn 1.15/1 between these and rolls maintained at 220° C. The drawn yarn was then relaxed at 3% to rolls maintained at 135° C. The yarn was taken up by a high speed winder at 4.60 km/min. The drawn yarn was 924 denier, 3.3 dpf, 5.8 g/d tenacity, 4.1 g/d LASE-5, 6.5 percent $E_{4.5}$, 10.3 percent ultimate elongation, 4.3 percent free shrinkage. The sum $E_{4.5}$, +FS was 10.8 percent. The undrawn yarn birefringence was 0.082 and IV was 0.92 dl/g. $R_f$ was $11\times10^{-3}$ and $R_e$ was $14\times10^{-2}$.

EXAMPLE 3

Yarn (IV=0.92) was produced in a similar manner to that in Example 1, only (a) a 2-inch sleeve was heated to 220°-300° C. (b) the spinneret orifice was 0.018 inch, and (c) Q was 1.0 $cm^3$/min/cap. The drawn yarn was taken-up at 4.72 km/mins after experiencing a 2.46/1 hot draw ratio. This yarn had similar properties to Example I: 3.3 dpf, tenacity of 8.1 g/d, ultimate elongation of 10.0%, LASE-5 of 3.9 g/d, $E_{4.5}$ of 5.5%, and free shrinkage of 10.0%. The 0.028 undrawn birefringence corresponded to a $R_f$ of $11\times10^{-3}$. $R_e$ was $13\times10^{-2}$.

EXAMPLE 4

A high viscosity yarn (IV=0.88) was prepared similar to Example 2 only D=0.018 inches and V=3.5 km/min. The undrawn yarn had a birefringence of 0.088 which corresponds to $R_f=9.8\times10^{-3}$. Drawn dpf was 2.7 and $R_e$ was $11\times10^{-2}$.

TABLE I

| | | V | Prior Art Examples* | | |
|---|---|---|---|---|---|
| Δn | IV(dl/g)@ | (km/min) | $R_f(10^{-3})$ | $R_e(10^{-2})$ | Ref. |
| 0.021 | 0.96 | 2.0 | 5.9 | 7.7 | U.S. Pat. No. 4,491,657 |
| 0.039 | 0.96 | 3.05 | 4.7 | 6.9 | U.S. Pat. No. 4,491,657 |
| 0.052 | 0.96 | 3.5 | 4.7 | 6.7 | U.S. Pat. No. 4,491,657 |
| 0.072 | 0.95 | 4.0 | 5.2 | 6.4 | U.S. Pat. No. 4,491,657 |
| 0.088 | 0.95 | 4.5 | 4.8 | 6.4 | U.S. Pat. No. 4,491,657 |
| 0.097 | 0.95 | 5.0 | 4.4 | 6.2 | U.S. Pat. No. 4,491,657 |
| 0.073 | 0.90 | 3.5 | 7.5 | 8.9 | U.S. Pat. No. 4,690,866 |

*Includes only drawn dpf of at least 2.5 and IV between 0.85 and 0.96.
@60:40 Phenol/Tetrachloroethylene solvent.

What is claimed:

1. A process for production of a dimensionally stable drawn polyethylene terephthalate multifilament yarn having filaments of at least 2.5 denier per filament comprising the steps of:

a) extruding a polyethylene terephthalate polymer melt through a spinnerette having a plurality of extrusion orifices to form filaments, said extrusion orifices having a diameter D of less than 0.055 inches;

b) advancing the extruded multifilament yarn first through a delay zone then through a quenching zone to solidify the filaments in a controlled manner;

c) withdrawing the solidified multifilament yarn from the quenching zone at a desired spinning speed V; whereby steps a) through c) are performed under conditions to form a partially-oriented multifilament yarn having an undrawn birefringence ($\Delta n_u$) of at least 0.020 and wherein $\Delta n_u=R_f V^{2.0} IV^{2.4}$ where IV is the intrinsic viscosity of the undrawn yarn and is at least 0.80 and $R_f$ is at least $9.0\times10^{-3}$; then d) hot drawing the partially-oriented multifilament yarn.

2. The process of claim 1 wherein $R_f$ is at least $15\times10^{-3}$.

3. The process of claim 1 wherein $R_f=R_rR_e$ and $R_e$ is at least $10.5\times10^{-2}$.

4. The process of claim 3 wherein $R_e$ is at least $13\times10^{-2}$.

5. The process of claim 1 wherein IV is 0.80 to 0.95 and $\Delta n_u$ is at least $7.0\times10^{-3}V^2$.

6. The process of claim 5 wherein $\Delta n_u$ is at least $11.5\times10^{-3}V^2$.

7. The process of claim 1 wherein IV is at least 0.85.

8. The process of claim 1 wherein the diameter D of said extrusion orifices is at least 0.027 inches.

9. The process of claim 1 additionally comprising the step of polymerizing said polyethylene terephthalate polymer, thereby having a continuous polymerization and direct melt spinning process.

10. The process of claim 9 wherein said polymerization step occurs in the absence of a molecular weight enhancing additive.

11. The process of claim 1 wherein said hot drawing step (d) continuously follows said withdrawing step (c), thereby having a continuous spin-draw process.

12. The process of claim 11 wherein IV is 0.80 to 0.95 and $\Delta n_u$ is at least $7.0\times10^{-3}V^{-2}$.

13. The process of claim 12 wherein $\Delta n_u$ is at least $11.5\times10^{-3}V^2$.

14. The process of claim 11 wherein IV is at least 0.85.

15. The process of claim 11 wherein the diameter D of said extrusion orifices is at least 0.027 inches.

16. The process of claim 9 wherein said hot drawing step (d) continuously follows said withdrawing step (c), thereby having a continuous polymerization and spin-draw process.

17. The process of claim 16 wherein said polymerization step occurs in the absence of a molecular weight enhancing additive.

18. The process of claim 16 wherein IV is 0.80 to 0.95 and $\Delta n_u$ is at least $7.0\times10^{-3}V^2$.

19. The process of claim 18 wherein $\Delta n_u$ is at least $11.5\times10^{-3}V^2$.

20. The process of claim 16 wherein IV is at least 0.85.

21. The process of claim 16 wherein the diameter D of said extrusion orifices is at least 0.027 inches.

22. The process of claim 1 wherein said melt consists essentially of polyethylene terephthalate polymerized in the absence of a molecular weight enhancing additive.

23. The process of claim 1 wherein in step (d) said yarn is drawn to at least 85 percent of the maximum draw ratio.

24. The process of claim 1 wherein $\Delta n_u/IV^{2.4}$ is at least 0.098.

* * * * *